US009796172B2

(12) United States Patent
Rodriguez

(10) Patent No.: US 9,796,172 B2
(45) Date of Patent: Oct. 24, 2017

(54) APPARATUS, SYSTEM, AND METHOD FOR MARKING A SUBSTRATE

(71) Applicant: Hector Rene Rodriguez, Layton, UT (US)

(72) Inventor: Hector Rene Rodriguez, Layton, UT (US)

(73) Assignee: Hector Rene Rodriguez, Layton, UT (US)

( * ) Notice: Subject to any disclaimer, the term of this patent is extended or adjusted under 35 U.S.C. 154(b) by 0 days.

(21) Appl. No.: 14/272,397

(22) Filed: May 7, 2014

(65) Prior Publication Data

US 2014/0331879 A1 Nov. 13, 2014

Related U.S. Application Data

(60) Provisional application No. 61/820,506, filed on May 7, 2013.

(51) Int. Cl.
*B41F 17/00* (2006.01)

(52) U.S. Cl.
CPC ..... *B41F 17/001* (2013.01); *B41P 2200/31* (2013.01)

(58) Field of Classification Search
CPC ..... B41F 15/00; B41F 17/00; B41F 17/001; B41F 17/003; B41F 17/005; B41F 17/38; B41P 2200/31
USPC ..... 101/35, 41, 44, 150, 163, 167, 169, 193
See application file for complete search history.

(56) References Cited

U.S. PATENT DOCUMENTS 4,423,680 A * 1/1984 Bishop ..... B41F 17/24 101/318
4,557,195 A * 12/1985 Phlipp ..... B41F 17/001 101/163
4,905,594 A 3/1990 Phillip et al.
5,111,745 A * 5/1992 Wilson ..... B41K 1/02 101/103
5,119,724 A * 6/1992 Ng ..... B41F 17/001 101/104
5,272,973 A * 12/1993 Chojnacki ..... B41F 17/001 101/163
5,419,247 A * 5/1995 Bachmann ..... B41F 17/001 101/318
5,476,040 A 12/1995 Kleist
5,537,921 A * 7/1996 Adner ..... B41F 17/001 101/35

(Continued)

*Primary Examiner* — Matthew G Marini
*Assistant Examiner* — Marissa Ferguson Samreth
(74) *Attorney, Agent, or Firm* — Kunzler Law Group

(57) ABSTRACT

Embodiments of a system are described. In one embodiment, the system includes an ink template platform having a surface for engaging an ink template. The ink template may have a recess or engraving for receiving ink. Supports are configured to slideably position the ink template platform between a first and second position. The first position is a position for receiving ink, and the second position for delivering ink. The system also includes an ink capsule biased on a surface of the ink template. The ink capsule is slidably positionable on the ink template to deliver ink to the recess in response to the platform being positioned in the ink receiving position. An ink capsule biasing member applies a pressure to the ink capsule that is sufficient to remove excess ink from the ink template. Other embodiments of the system are also described.

20 Claims, 9 Drawing Sheets

(56) References Cited

U.S. PATENT DOCUMENTS

| | | | | |
|---|---|---|---|---|
| 5,577,442 | A * | 11/1996 | Tanaka | B41F 17/001 101/163 |
| 5,662,041 | A | 9/1997 | Kleist | |
| 5,875,716 | A * | 3/1999 | Scheuhing | B41F 17/001 101/170 |
| 5,921,177 | A | 7/1999 | Shin | |
| 6,813,998 | B2 | 11/2004 | Roebuck | |
| 6,931,988 | B1 * | 8/2005 | Sherf | B41F 17/001 101/163 |
| 7,334,521 | B2 * | 2/2008 | Moody | B41K 1/04 101/103 |
| 2005/0174398 | A1 * | 8/2005 | Hessert | B41J 2/175 347/85 |
| 2006/0213380 | A1 * | 9/2006 | Reinholdt | B41F 17/001 101/41 |
| 2008/0223235 | A1 * | 9/2008 | Schaafsma | B41F 17/001 101/169 |
| 2009/0178583 | A1 * | 7/2009 | Gosis | B41F 17/001 101/163 |
| 2010/0040851 | A1 * | 2/2010 | Schroeder | B41F 17/001 428/217 |
| 2011/0023737 | A1 * | 2/2011 | Vogt | B41F 17/001 101/163 |
| 2014/0255274 | A1 * | 9/2014 | Yao | B41F 17/001 422/547 |

* cited by examiner

APPARATUS, SYSTEM, AND METHOD FOR MARKING A SUBSTRATE

CROSS-REFERENCE TO RELATED APPLICATIONS

This application claims the benefit of U.S. Provisional Application No. 61/820,506, filed on May 7, 2013, which is incorporated by reference herein in its entirety.

BACKGROUND

Pad printing is a process by which an engraving in a pad, or ink template, is filled with ink and then pressed against an object or substrate to transfer a facsimile or stamp of the engraving to the object. Traditionally, a pad printer includes an ink cup for transferring ink to the engraving. However, oftentimes excessive ink is applied to the engraving which results in a messy stamp. Wiping the engraving of excessive ink helps, unfortunately, if too much force is used while wiping, too much ink may be removed and the stamp not effectively transferred.

SUMMARY

Embodiments of a system are described. In one embodiment, the system includes an ink template platform having a surface for engaging an ink template. The ink template may have a recess or engraving for receiving ink. Supports are configured to slideably position the ink template platform between a first and second position. The first position is a position for receiving ink, and the second position for delivering ink. The system also includes an ink capsule biased on a surface of the ink template. The ink capsule is slidably positionable on the ink template to deliver ink to the recess in response to the platform being positioned in the ink receiving position. An ink capsule biasing member applies a pressure to the ink capsule that is sufficient to remove excess ink from the ink template.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

In order that the advantages of the subject matter will be readily understood, a description of the subject matter will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present subject matter. Thus, appearances of the phrases "in one embodiment," "in an embodiment," and similar language throughout this specification may, but do not necessarily, all refer to the same embodiment.

Furthermore, the described features, structures, or characteristics of the subject matter may be combined in any suitable manner in one or more embodiments. In the following description, numerous specific details are provided for a thorough understanding of embodiments of the subject matter. One skilled in the relevant art will recognize, however, that the subject matter may be practiced without one or more of the specific details, or with other methods, components, materials, and so forth. In other instances, well-known structures, materials, or operations are not shown or described in detail to avoid obscuring aspects of the subject matter.

Figure 1:
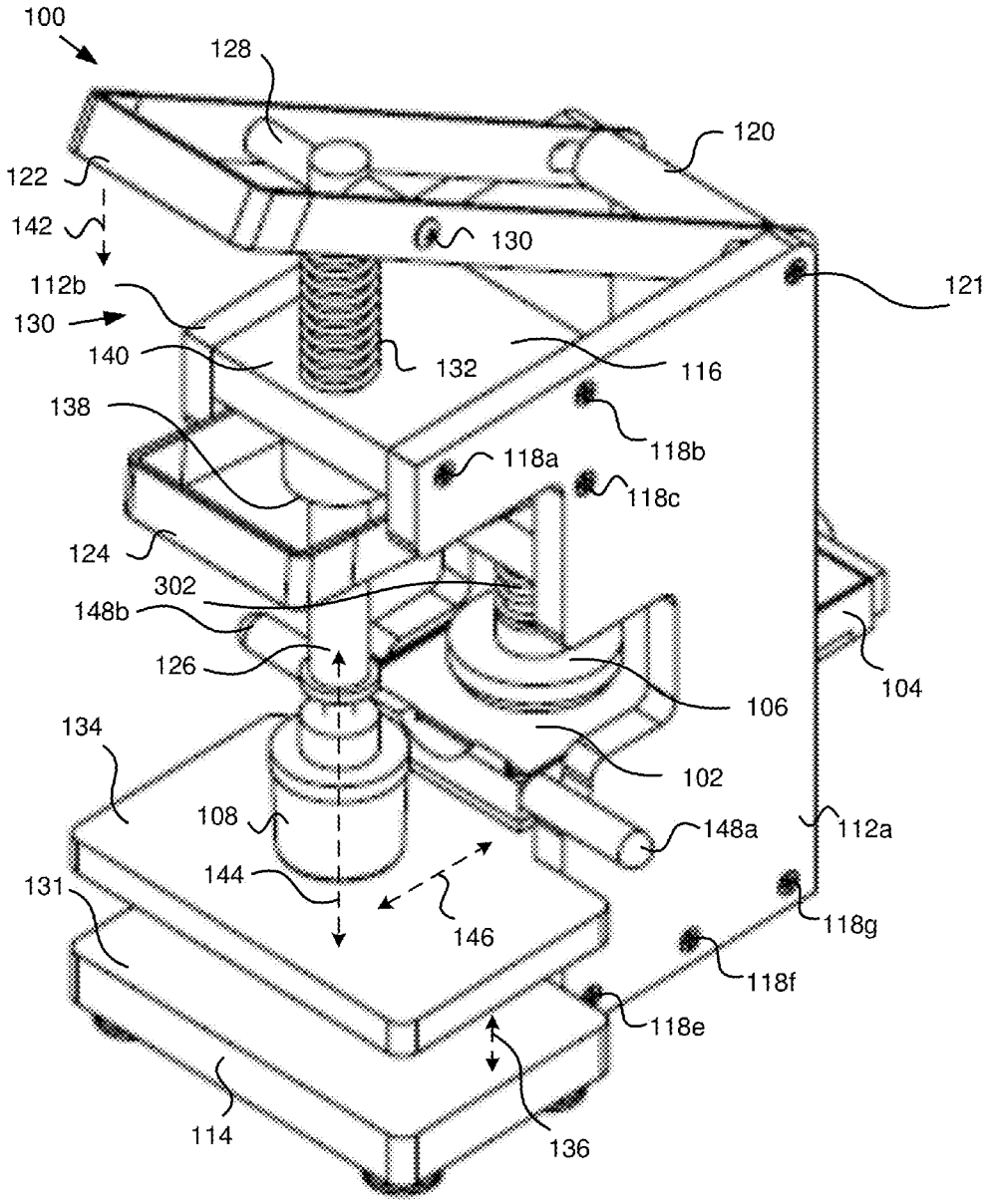
FIG. 1 depicts a perspective view of one embodiment of an apparatus 100 for marking a substrate.

FIG. 1 depicts a perspective view of one embodiment of an apparatus 100 for marking a substrate. The apparatus 100, in certain embodiments, includes an ink template 102, an ink template platform 104, at least one platform support 202*a* and 202*b* (see FIGS. 2 and 3), an ink capsule 106, and a stamping member 108. The apparatus 100, as further described below, is configured to deliver a stamping material (typically ink or another marking material) to a substrate (not shown).

The apparatus 100, in certain embodiments, is supported by a pair of walls 112*a* and 112*b* (collectively walls 112) disposed opposite one another. In one embodiment, the walls 112*a* and 112*b* are mirror images of one another. The walls 112 are coupled to a base member 114 at one end of the walls 112, and at an opposing end, to a stamp shaft guiding block 116. The walls 112 may be coupled to the base member 114 and the stamp shaft guiding block 116 by one or more fasteners 118. In one embodiment, the walls 112 may also be coupled to an upper pivot 120 by a fastener 121. The upper pivot forms a pivot for an upper handle assembly 130, the operation of which is further described below.

The base member 114, the stamp shaft guiding block 116 and the upper pivot 120 help to maintain the walls 112 in an upright position. In certain embodiments, the walls 112 may also be coupled to a middle pivot 502 of a lower handle assembly 500 (see FIG. 5), the operation of which is further described below.

In certain embodiments, the upper handle assembly 130 includes an upper handle 122, a stamp shaft guiding block 116, a stamp shaft 126, a stamp shaft pivot 128, a stamping member 108, and a stamp shaft biasing member 132. The upper handle 122 is coupled to a stamp shaft 126 by a rod or screw 130 that extends through the upper handle 122 and a stamp shaft pivot 128. The stamp shaft pivot 128 extends through the stamp shaft 126 which is, in turn, coupled to the stamping member 108. The stamp shaft 126 extends through the stamp shaft guiding block 116 which keeps the stamp shaft aligned along a longitudinal axis of the stamp shaft 126.

Raising the upper handle 122 of the upper handle assembly 130 operates to raise the stamp shaft 126 and therefore raises the stamping member 108. Lowering the upper handle 122 lowers the stamp shaft 126 and therefore lowers the stamping member 108. As will be discussed below, the stamping member 108 is positionable by virtue of the upper handle assembly 130, between an upper or extended position and a stamping position. In the stamping position, the stamping member 108 is positioned in contact with an area where a stamping substrate would be positioned. For example, in certain embodiments the stamping position would be an area above an upper surface 131 of the base member 114. That is, in certain embodiments, an item for printing or marking would be placed on the upper surface 131 of the base member 114 and this area would be defined as the stamping position.

In other embodiments, the stamping position may be defined as an area above an adjustable platform 134. For example, in one embodiment, a user may wish to position the stamping substrate on the adjustable platform 134 to limit the distance that the stamping member 108 needs to travel to stamp the stamping substrate. The adjustable platform 134, in such an embodiment, may be adjustable in a direction indicated by arrow 136. In other words, the adjustable platform 134 is positionable along an axis parallel to a direction or line of travel of the stamping member 108, generally indicated by arrow 144.

In certain embodiments, in the extended position, the stamping member 108 is positioned out of contact with the stamping substrate. In one embodiment, in the extended position, the stamping member 108 is withdrawn away from the stamping substrate at a maximum distance allowable by the stamp shaft guiding block 116. That is, in one embodiment, in the extended position, the stamping member 108 may be positioned as close to the lower end 138 of the stamp shaft guiding block 116 as possible.

In certain embodiments, the stamp shaft biasing member 132 is configured to bias the stamp shaft 126 in a withdrawn position to position the stamping member 108 in the extended position. For example, in one embodiment, the stamp shaft biasing member 132 is a spring that engages a top surface 140 of the stamp shaft guiding block 116 and the stamp shaft pivot 128 to withdraw the stamp shaft 126 to a position that puts the stamping member out of contact with a stamping substrate.

To reposition the stamping member 108, the user grasps the upper handle 122 and lowers the upper handle 122 in the direction indicated by arrow 142. Moving the upper handle 122 in the direction indicated by arrow 142 repositions the stamping member 108 into the stamping position. When a user releases the upper handle 122, the stamp shaft biasing member 132 repositions the stamping member 108 to the extended position.

In certain embodiments, the stamping member 108 is also repositionable in an inking position. In such an embodiment, the stamping member 108 is positioned in contact with the ink template 102 to pick up ink from the ink template 102.

To deliver ink to the stamping member 108 from the ink template 102 the ink template 102 is positioned in the line of travel of the stamping member 108. In the embodiment illustrated in FIG. 1, the line of travel of the stamping member 108 is indicated by arrow 144. The ink template 102 is repositioned into the line of travel 108 of the stamping member 108 by moving the ink template platform 104 in the direction indicated by arrow 146. With the ink template 102 positioned in the line of travel 146 of the stamping member 108, the user can actuate the upper handle 122 to force the stamping member 108 into contact with the ink template 102 to pick up ink from the ink template 102.

Once the stamping member 108 has picked up ink from the ink template 102, the ink template 102 may be positioned out of the line of travel 144 of the stamping member 108 by moving the ink template platform 104 in the direction of arrow 146. A substrate to be stamped can then be positioned on either the upper surface 131 of the base member 114 or on the adjustable platform 134 and the upper handle 122 can again be actuated to deliver the ink to the substrate to be stamped.

In certain embodiments, the ink template platform 104 may include one or more handles 148*a* and 148*b* to assist the user in repositioning the ink template platform 104. In an exemplary embodiment, the one or more handles 148*a* and 148*b* may act as stops to stop the ink template platform 104 from being further repositioned within the apparatus 100. In a first position, the ink template platform 104 may be considered to be in an ink receiving position. In such an embodiment, the one or more handles 148*a* and 148*b* stop the ink template platform 104 in a position wherein a recess 402 (see FIG. 4) for receiving ink in the ink template 102 is positioned below the ink capsule 106 to deliver ink to the recess 402 in the ink template 102. When the recess 402 is repositioned into the line of travel 108 of the stamping member 108, the ink template platform 104 may be considered to be in an ink delivering position.

With the ink template platform 104 positioned in the ink receiving position, ink is delivered to the recess 402 in the ink template 102 from the ink capsule 106. In certain embodiments, the ink capsule ink capsule 106 is a receptacle for retaining ink. The receptacle includes at least one surrounding wall 602 (see FIG. 6) with at least one edge 604 of the receptacle 606 contacting the ink template 102 to scrape excess ink from the ink template 102. In one embodiment, scraping excess ink from the ink template 102 occurs when the ink template platform 104 is repositioned from the ink receiving position to the ink delivering position.

Figure 2:
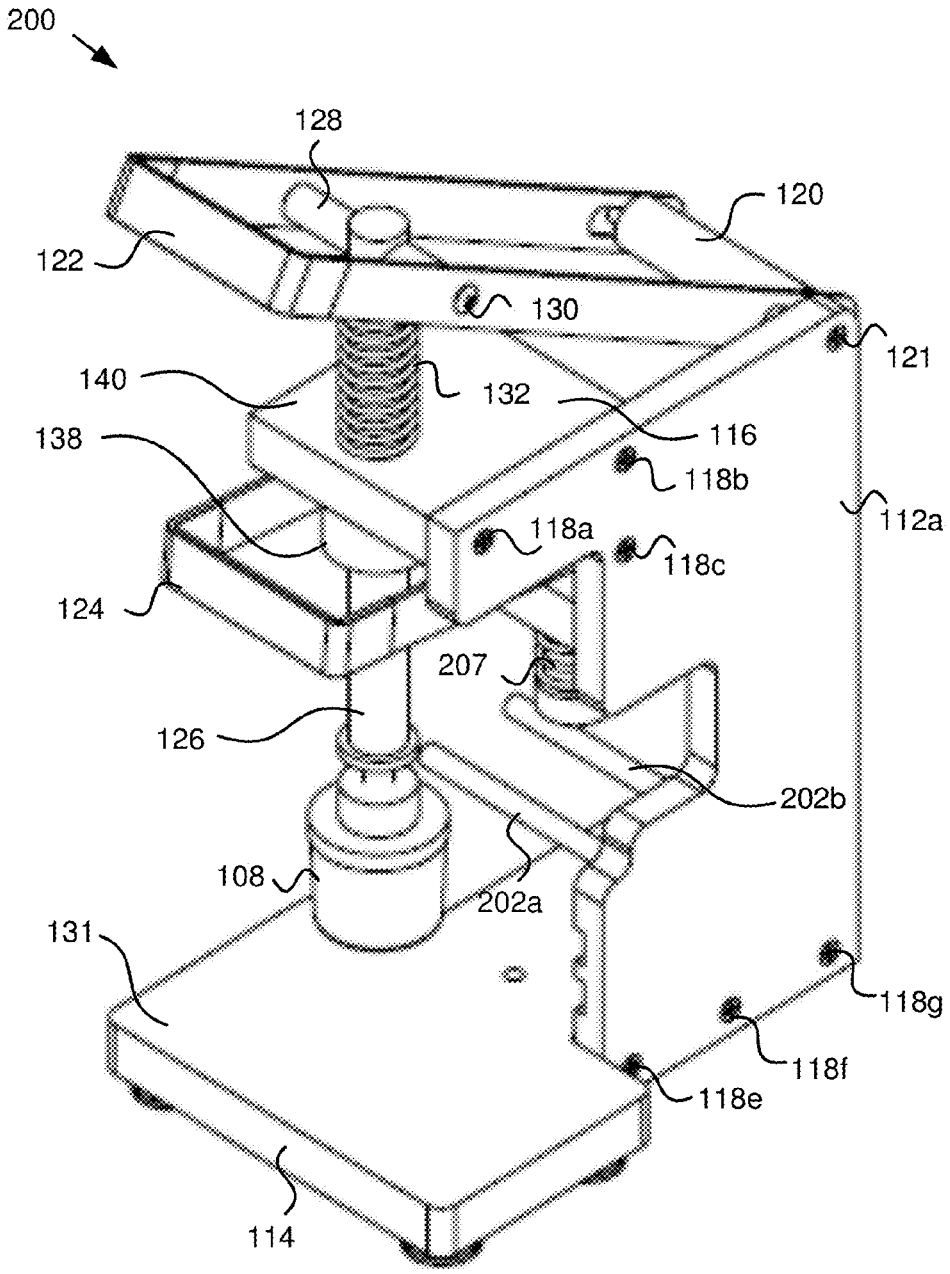
FIG. 2 depicts a perspective view of one embodiment of an apparatus for marking a substrate.

FIG. 2 is a perspective view diagram of one embodiment of an apparatus 200 for marking a substrate. The apparatus 200 for marking a substrate is substantially similar to the apparatus 100 for marking a substrate discussed above. In the embodiment illustrated in FIG. 2, one wall, wall 112*b* has been removed for clarity. Additionally, the ink template platform 104, ink template 102, and adjustable platform 134 have been removed to aid in the description of apparatus 200. One of skill in the art will recognize that in typical embodiments, the apparatus 200 will include the ink template platform 104, the ink template 102, and the adjustable platform 134.

As discussed above, the ink template platform 104 is supported by one or more platform supports 202*a* and 202*b* (collectively platform supports 102). In the embodiment illustrated in FIG. 2, the apparatus 200 includes at least two platform supports 202*a* and 202*b*. The platform supports 202, may be rollers that support the ink template platform 104 and allow the ink template platform 104 to roll along the platform supports as the ink template platform 104 is repositioned between the first position (ink receiving position) and the second position (ink delivering position).

In certain embodiments, the platform supports 202 support distal or end portions 404*a* and 404*b* (see FIG. 4) of the ink template platform 104 and pressure is applied to a center portion 408 of the ink template 102 on a top surface 410 of the ink template 102. In such an embodiment, the platform supports 202 support a bottom surface 412 of the ink template platform 104 while pressure is applied to the top surface 410 of the ink template 102 in the center portion 408 of the ink template 102 to keep the ink template platform 104 and the ink template 102 in position on the platform supports 202.

Figure 6:
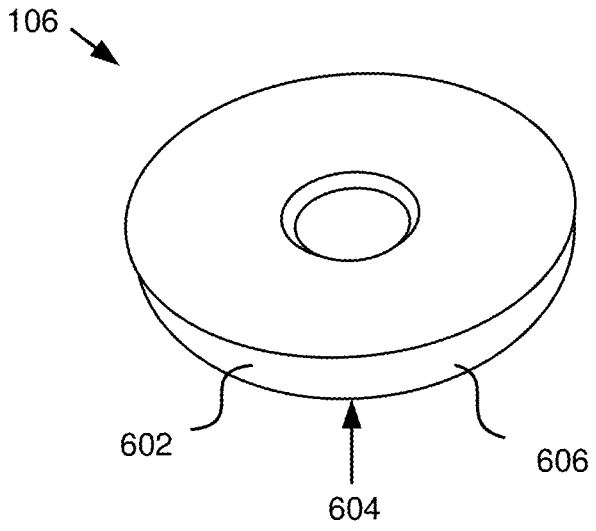
FIG. 6 depicts a perspective view of one embodiment of an ink capsule in accordance with the present subject matter.

In certain embodiments, the apparatus 200 includes an ink capsule biasing member 207 that biases the ink capsule 106 against the center portion 408 of the ink template 102 on the top surface 410 of the ink template 102 to keep the ink template 102 in position on the platform supports 202. Referring briefly now to FIG. 6, in one embodiment, the ink capsule biasing member 207 biases an edge 604 of the receptacle 606 against the ink template 102 with sufficient force to remove excess ink from the top surface 410 of the ink template 102 when the ink template platform 104 is repositioned between the ink receiving position and the ink delivering position. That is to say, the ink capsule biasing member 207 applies a force to the receptacle 606 that is sufficient to skim excess ink from the ink template 102.

Figure 3:
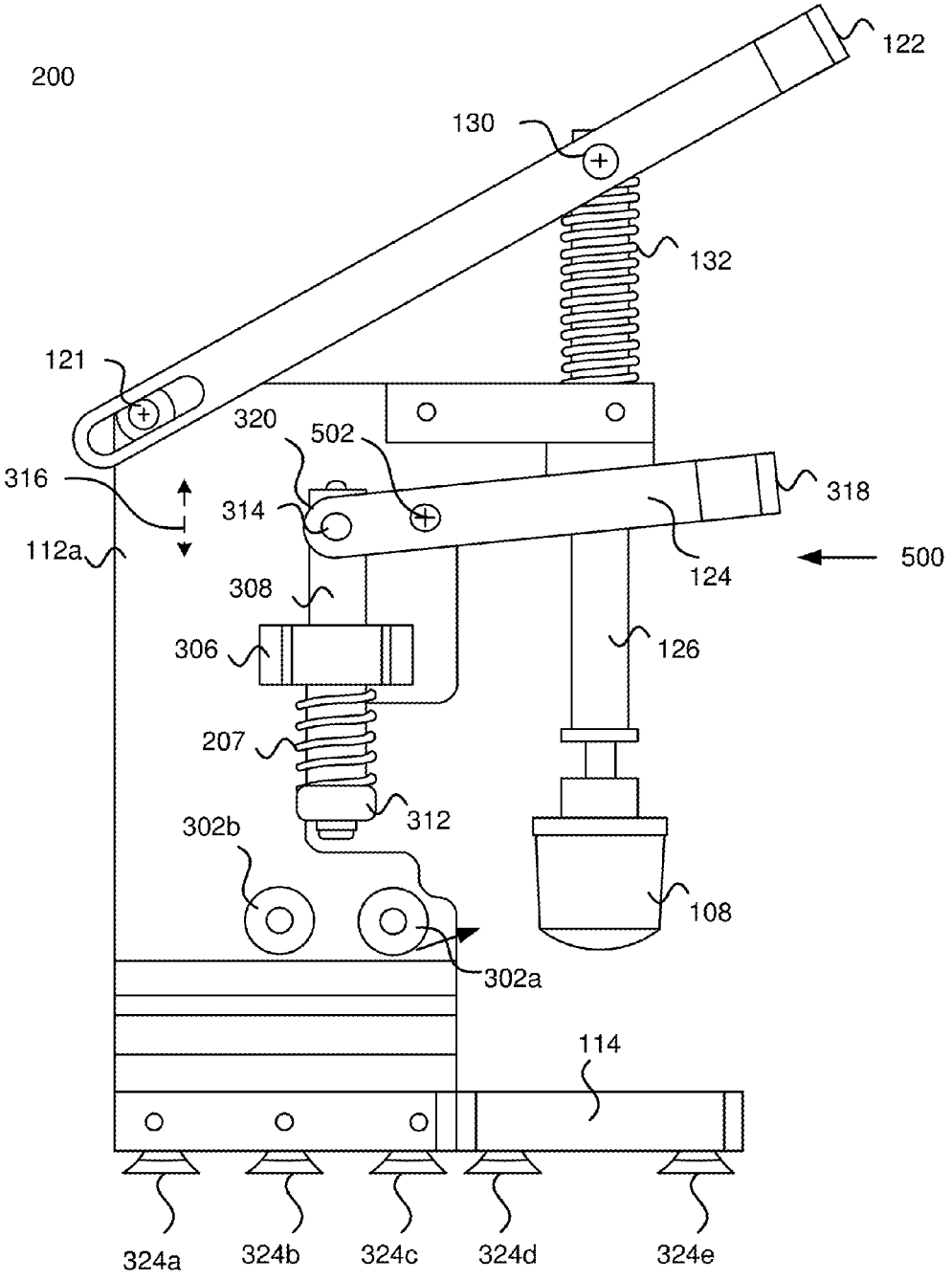
FIG. 3 depicts a side view further illustrating the apparatus of FIG. 2 in accordance with one embodiment of the present subject matter.

FIG. 3 depicts a side view further illustrating the apparatus 200 of FIG. 2 in accordance with one embodiment of the present subject matter. In the embodiment illustrated in FIG. 2, the platform supports 202*a* and 202*b* have been removed to show how bearings 302*a* and 302*b* fit into place in each wall of the apparatus 200. The bearings assist in allowing the platform supports 202 to roll as the ink template platform 104 is repositioned between the ink receiving position and the ink delivering position.

In the embodiment illustrated in FIG. 3, a lower handle assembly 500 is more clearly depicted. The lower handle assembly 500, in one embodiment, includes a lower handle 124, a spring plate 306, an ink capsule shaft 308, the ink capsule biasing member 207, ink capsule biasing member stop 312, an ink shaft slider 314, and a middle pivot 502.

In certain embodiments, the lower handle assembly 500 operates to raise and lower the ink capsule shaft 308 to retrieve the ink capsule 106 for refilling the ink capsule with a marking substance such as ink. The ink capsule shaft 308 is positioned through the spring plate 306 which acts to guide the ink capsule shaft 308 in a substantially straight line along a longitudinal axis of the ink capsule shaft 308. The spring plate 306, in certain embodiments, is coupled to the walls 112*a* and 112*b* in such a manner as to inhibit rotation of the spring plate 306.

Middle pivot 502 is also coupled to the walls 112*a* and 112*b* and the lower handle 124 pivots about middle pivot 502 to raise or lower the ink shaft slider in the direction indicated by arrow 316. Pressing down on the end 318 of the lower handle 124 causes the lower handle 124 to pivot about the middle pivot 502 raising the opposite end 320 of the lower handle 124. Lifting the end 318 of the lower handle 124 causes the lower handle 124 to pivot about the middle pivot 502 lowering the opposite end 320 of the lower handle 124.

One end 320 of the lower handle 124 is coupled to the ink capsule shaft 308 by the ink shaft slider 314 which is positioned through the ink capsule shaft. This coupling causes the ink capsule shaft 308 to raise and lower in response to raising and/or lowering the opposite end 318 of the lower handle 124. Raising the ink capsule shaft 308, in certain embodiments, allows access to the ink capsule 106 so that a user can refill the ink capsule 106.

In certain embodiments, the ink capsule biasing member 207 engages the spring plate 306 and the ink capsule biasing member stop 312 to bias the ink capsule 106 against the top surface 410 of the ink template 102. As discussed above, the ink capsule biasing member 207 may bias the ink capsule 106 against the top surface 410 of the ink template 102 with sufficient force to remove excess ink from the ink template 102 when the ink template platform 104 is repositioned between the ink receiving position and the ink delivering position.

FIG. 2 also depicts adjustment slots 322 that are configured to receive the adjustable platform 134 to adjust a height of the adjustable platform and thus the height at witch a substrate may be stamped. In the depicted embodiment, the apparatus 200 includes two adjustment slots 322*a* and 322*b*. One of skill in the art will recognize that in other embodiments, the apparatus 200 may include additional adjustment slots to allow for additional adjustment options.

Also shown in the embodiment illustrated in FIG. 3 are a plurality of base member coupling elements 324*a*-324*e* coupled to the base member 114. In certain embodiments, the base member coupling elements 324*a*-324*e* are suction cups configured to couple the base member 114 to a support surface.

Figure 4:
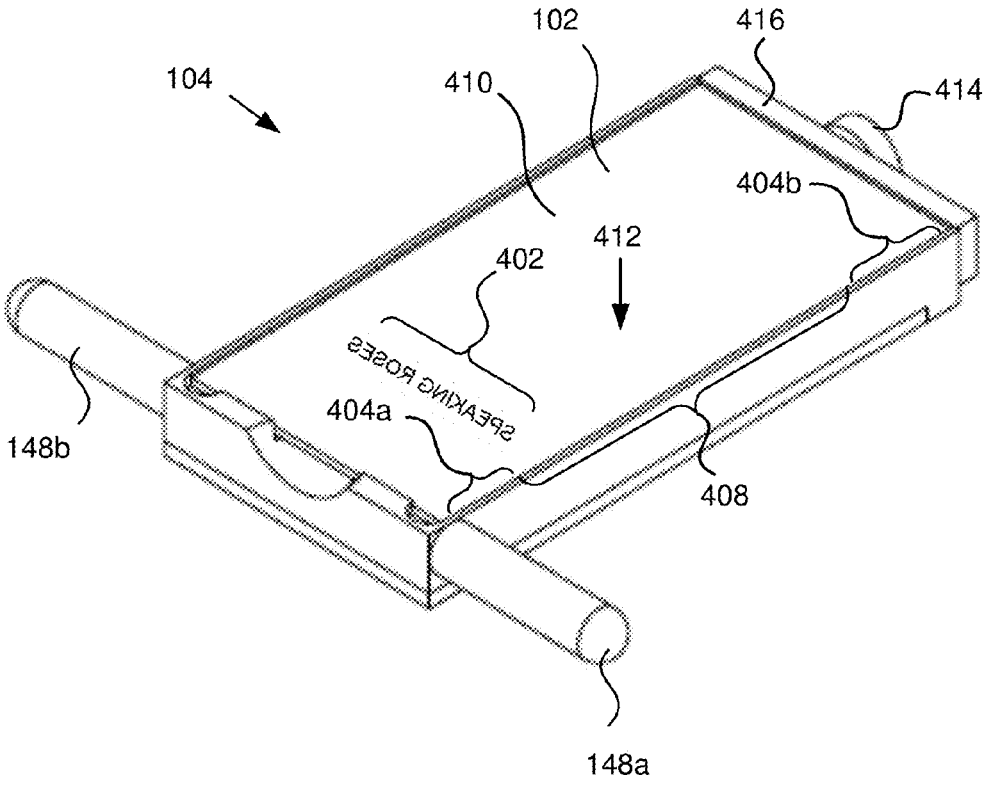
FIG. 4 depicts a perspective view of one embodiment of an ink template platform housing an ink template.

FIG. 4 depicts a perspective view of one embodiment of an ink template platform 104 housing an ink template 102. In certain embodiments, the ink template platform 104 includes a recess 412 having a depth sufficient to receive the ink template 102 while leaving the top surface 410 of the ink template 102 accessible to the ink capsule 106 for delivering ink and removing excess ink. In one embodiment, the ink template platform 104 may include a thumb screw 414 that engages a plate 416 that keeps the ink template 102 positioned within the recess 412 by compression.

The ink template 102, in certain embodiments, includes an engraving or recess 402 for receiving ink. In one embodiment, the recess 402 is etched into the top surface 410 of the ink template 102 and receives ink from the ink capsule 106. Any excess ink is removed from the top surface 410 of the ink template 102 by operation of the interaction between the edge 604 of the ink capsule 106 and the top surface 410 of the ink template 102. Thus, ink is only left in the recess 402 on the top surface 410 of the ink template 102. In the embodiment illustrated in FIG. 4, the recess 402 is formed into the words "SPEAKING ROSES." In other embodiments the recess 402 may be formed to include other words or alphanumeric phrases. In yet another embodiment, the recess 402 may be formed into artistic or other interesting shapes.

Once the ink template 102 has received ink in the recess 402 on the top surface 410 of the ink template 102 and the excess ink has been removed from the top surface 410 of the ink template 102, the ink template 102 is positioned in the inking position. In the inking position, the recess 402 in the top surface 410 of the ink template 102 is positioned in line with the line of travel 144 of the stamping member 108. In this position, the upper handle 122 is depressed to cause the stamping member 108 to come into contact with the upper surface 410 of the ink template 102 to retrieve ink from the ink template 102. Because the ink is only in the recess 402 on the ink template 102, the stamping member 108 only receives ink in the shape of the recess 402. The stamping member 108 is withdrawn from the top surface 410 of the ink template 102 by either lifting the upper handle 122 or by releasing the upper handle 122 and allowing the stamp shaft biasing member 132 to bias the stamping member in a position away from the top surface 410 of the ink template 102. The stamping member is now ready to deliver a marking substance (ink) to a substrate.

The ink template platform 104 is positioned in the ink receiving position which removes the ink template 102 from the line of travel 144 of the stamping member 108. To stamp a substrate, the substrate is positioned in line with the line of travel 144 of the stamping member 108, either on the base member 114 or on the adjustable platform 134. The upper handle 122 is once again actuated to cause the stamping member 108 to come into contact with the substrate to deliver the ink to the substrate.

Figure 5:
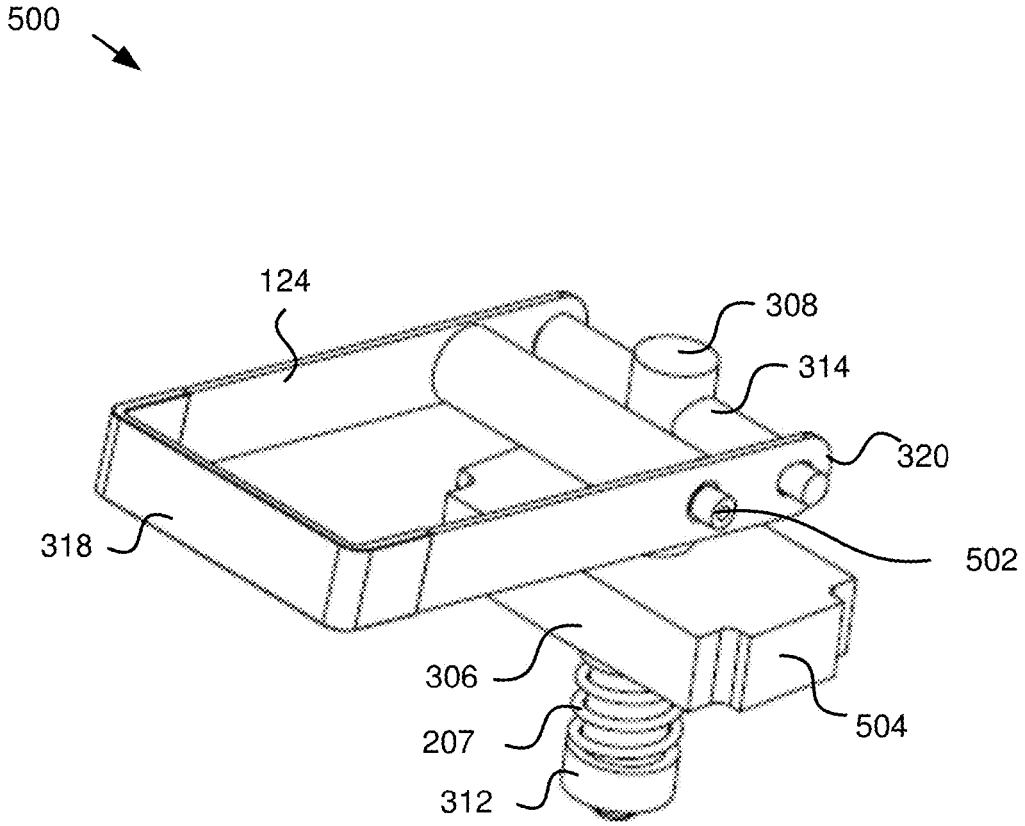
FIG. 5 depicts a perspective view of one embodiment of the lower handle assembly.

FIG. 5 depicts a perspective view of one embodiment of the lower handle assembly 500. The operation of the lower handle assembly was discussed above in relation to FIG. 3. In FIG. 5, the ink shaft slider 314 can clearly be seen as being positioned through the ink capsule shaft 308 to engage the ink capsule shaft 308. As discussed above, lowering end 318 of the lower handle 124 causes end 320 of the lower handle 124 to rise, allowing the ink capsule 106 to be removed from the apparatus 200. Releasing end 318 of the lower handle 124 allows the ink capsule biasing member 310 to bias the ink capsule 106 against the upper surface 410 of the ink template 102.

In certain embodiments, an end profile 504 of the spring plate 306 is shaped to be received within a void (not shown) in each wall 112*a* and 112*b* of the apparatus 100 or 200. In one embodiment, the fit between the end profile 504 of the spring plate 306 and the void within each wall 112*a* and 112*b* is such that rotation of the spring plate 306 is prohibited.

FIG. 6 depicts a perspective view of one embodiment of an ink capsule 106. In certain embodiments, the ink capsule 106 is a cylindrical receptacle for retaining ink. The receptacle includes at least one surrounding wall 602 with at least one edge 604 of the receptacle 606 contacting the ink template 102 to scrape excess ink from the ink template 102. In one embodiment, scraping excess ink from the ink template 102 occurs when the ink template platform 104 is repositioned from the ink receiving position to the ink delivering position. While the embodiment illustrated in FIG. 6 depicts the ink capsule 106 as being substantially cylindrical, one of skill in the art will recognize that in other embodiments the ink capsule 106 may have any other geometric shape.

Figure 7:
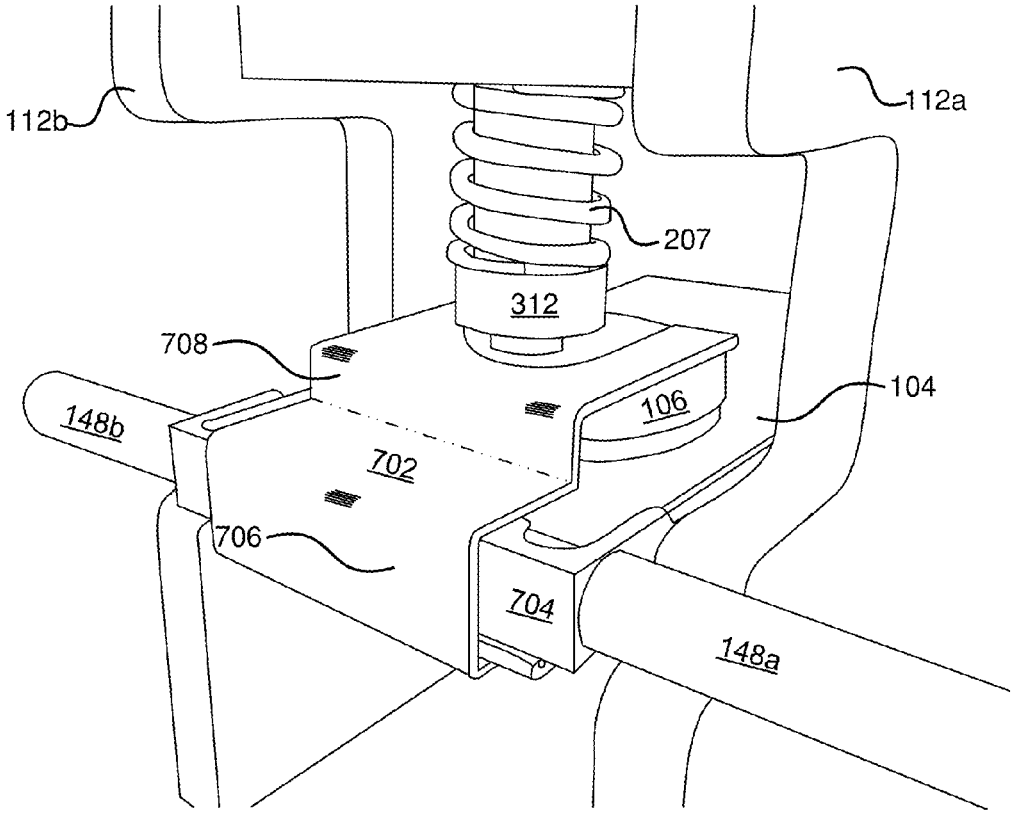
FIG. 7 depicts a perspective view of one embodiment of an ink capsule clip device (hereinafter "clip") in accordance with embodiments of the disclosure.

FIG. 7 depicts a perspective view of one embodiment of an ink capsule clip device (hereinafter "clip") 702 in accordance with embodiments of the disclosure. The clip 702 is configured for securing the ink capsule 106 to the ink template platform 104 so that the ink capsule 106 is secured to the ink template platform 104 while a user exchanges or removes the ink template platform 104. When removing or exchanging the ink template platform 104, the user moves the ink capsule biasing member stop 312 upward away from the ink capsule 106. This movement releases pressure on the ink capsule 106 that prevents ink from escaping the ink capsule 106. Beneficially, the clip 702 secures the ink capsule 106 to the ink template platform 104 and maintains the ink within the ink capsule 106. In one embodiment, the clip 702 maintains a pressure on the ink capsule 106 that is similar to the ink capsule biasing member 207, as described above.

The clip 702, in one embodiment, is formed of a rigid material such as aluminum or steel. The clip 702 is formed with a profile selected to engage the ink template platform 104 at the front portion 704 of the ink template platform 104 and the ink capsule 106. It is contemplated that many different profiles may be selected while still accomplishing the goal of securing the ink capsule 106 to the ink template platform 104. As depicted, the clip 702 includes a front retention portion 706 that engages the front portion 704 of the ink template platform 104. In other words, the front retention portion 706 wraps around the front portion 704.

The clip 702, in one embodiment, includes a step area 708 for engaging the ink capsule 106. The step area 708 may include substantially orthogonal transitions, as depicted. Alternatively, the step area may be sloped at an angle less than 90 degrees to transition from an ink template platform 104 engaging surface to an ink capsule 106 engaging surface.

Figure 8:
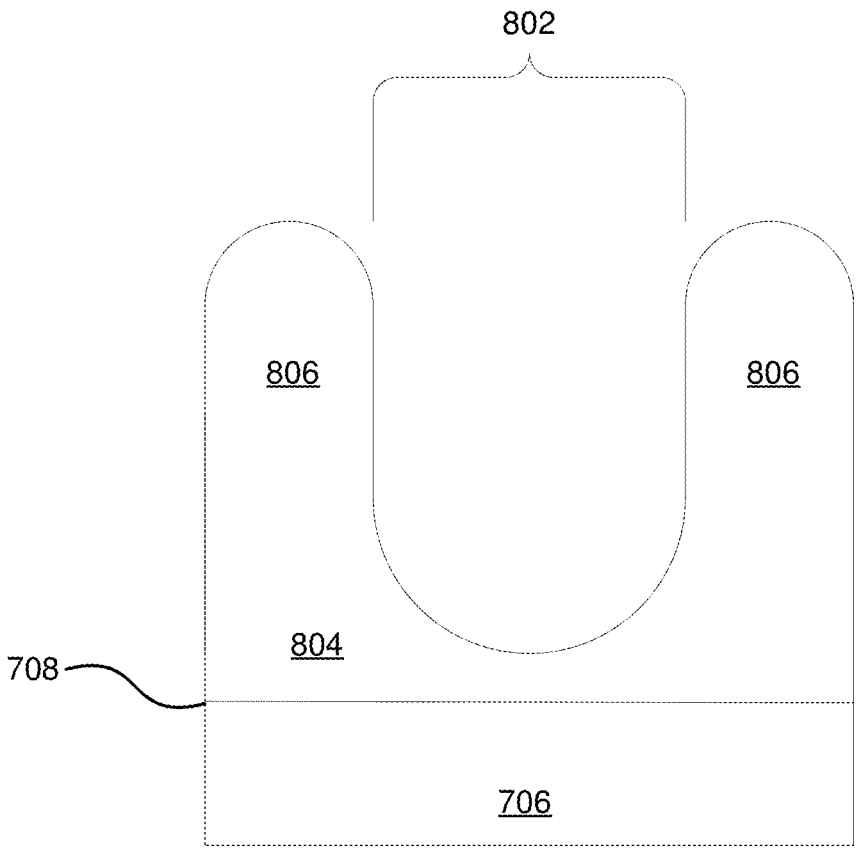
FIG. 8 is a top view diagram illustrating another embodiment of the clip in accordance with embodiments of the disclosure.

FIG. 8 is a top view diagram illustrating another embodiment of the clip 702 in accordance with embodiments of the disclosure. The clip 702 may include a cut-out portion 802 in the ink capsule engaging surface 804. Beneficially, the cut-out portion 802 allows for the clip 702 to be positioned while the ink capsule biasing member stop 312 is applying pressure to the ink capsule 106. The cut-out portion 802 defines lobes 806 that when positioned, extend over the ink capsule 106. The phrase "lobes" refers to support members that engage the ink capsule 106. Although the lobes 806 are depicted with rounded edges, the lobes 806 may be formed with substantially angular transitions or edges.

Figure 9:
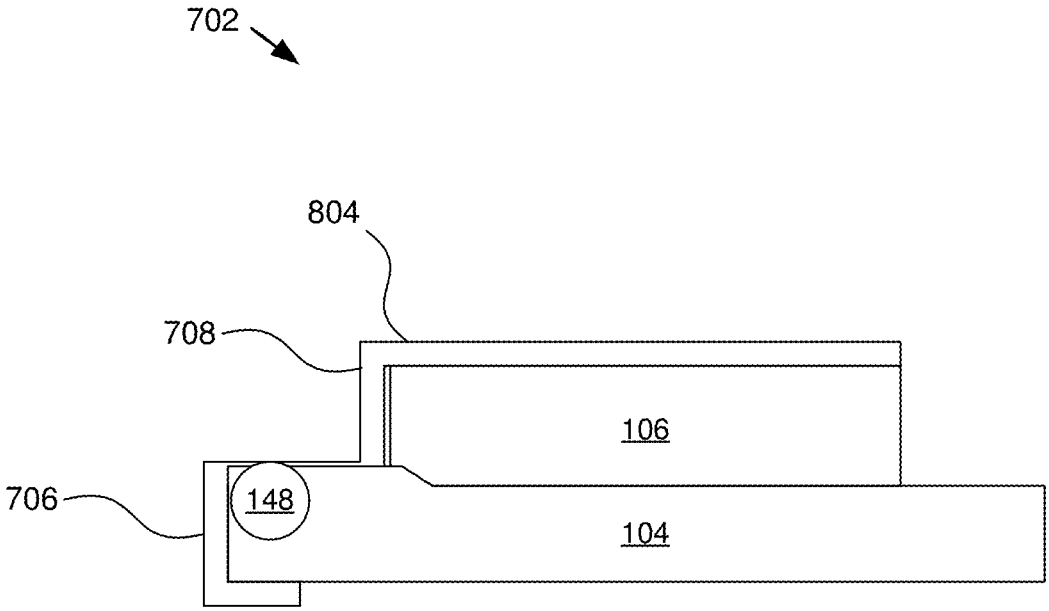
FIG. 9 is a side view diagram illustrating another embodiment of the clip in accordance with embodiments of the disclosure.

FIG. 9 is a side view diagram illustrating another embodiment of the clip 702 in accordance with embodiments of the disclosure. As described above, the clip 702 includes the front retention portion 706 that engages the ink template platform 104. In one embodiment, the front retention portion 706 is configured to secure to the ink template platform 104 by way of a compression fitting around the ink template platform 104. Alternatively, the front retention portion 706 may use any type of removable fastener (e.g., screw, adhesive, etc.) for securing the clip 702 to the ink template platform 104. The rigidity of the clip 702 provides a securing force to the ink capsule 106. However, in alternative embodiments, the clip 702 may include a fastener for securing the ink capsule engaging surface 804 to the ink capsule 106.

The present subject matter may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

an ink template comprising a recess for receiving ink;

an ink template platform comprising a surface for engaging the ink template;

at least one platform support wherein the ink template platform is slideably positionable between an ink receiving position and an ink delivering position using the at least one platform support, the ink template platform uncoupled from the at least one platform support while the ink template platform is in one of the ink receiving position and the ink delivering position such that the ink template platform is not permanently fastened to the at least one platform support;

an ink capsule positioned against a surface of the ink template, wherein the ink capsule delivers ink to the recess in response to the ink template platform being positioned in the ink receiving position; and a single ink capsule biasing member that positions the ink capsule against the surface of the ink template, the ink capsule biasing member centrically positioned against a top surface of the ink capsule.

2. The apparatus of claim 1, further comprising a stamping member configured for receiving ink from the ink template in response to the ink template platform being positioned in the ink delivering position.

3. The apparatus of claim 2, where the stamping member is configured for delivering the ink to a substrate, the delivered ink having a shape substantially similar to the shape of the recess or a mirror image of the shape of the recess in the ink template.

4. The apparatus of claim 2, where the stamping member is positionable between an extended position and a stamping position, where, in the stamping position, the stamping member is positioned in contact with the substrate and where, in the extended position, the stamping member is positioned out of contact with the substrate.

5. The apparatus of claim 4, wherein the stamping member is further positionable in an inking position, where, in the inking position, the stamping member is positioned in contact with the ink template.

6. The apparatus of claim 1, where the ink capsule comprises a receptacle for retaining ink, the receptacle having a surrounding wall wherein at least one edge of the receptacle contacts the ink template to scrape excess ink from the ink template.

7. The apparatus of claim 6, wherein the ink capsule biasing member biases the at least one edge of the receptacle against the ink template with sufficient force to remove excess ink from a surface of the ink template when the ink template platform is repositioned between an ink receiving position and an ink delivering position.

8. The apparatus of claim 6, where ink disposed within the recess in the ink template remains within the recess upon repositioning the ink template platform from the ink receiving position to the ink delivering position.

9. The apparatus of claim 1, further comprising a stamp shaft coupled to the stamping member, the stamp shaft linearly moveable along a longitudinal axis of the shaft to reposition the stamping member.

10. The apparatus of claim 9, further comprising a stamp shaft biasing member configured to bias the stamp shaft in a withdrawn position to position the stamping member in an extended position, the extended position comprising a position wherein the stamping member is out of touch with the substrate.

11. An apparatus to mark a substrate, the apparatus comprising:

an ink template having a recess for receiving ink;

an ink template platform positioned on and supported by at least one platform support, the ink template platform positionable between an ink receiving position and an ink delivering position, the ink template platform having a surface for receiving the ink template, the ink template platform uncoupled from the at least one platform support while the ink template platform is in one of the ink receiving position and the ink delivering position such that the ink template platform is not permanently fastened to the at least one platform support;

an ink capsule configured to deliver ink to the recess within the ink template with the ink template platform positioned in the ink receiving position;

a single ink capsule biasing member that positions the ink capsule against the surface of the ink template, the ink capsule biasing member centrically positioned against a top surface of the ink capsule;

a stamping member configured to receive ink from the ink template with the ink template platform positioned in the ink delivering position; and wherein the stamping member is configured to deliver the ink to a substrate, the delivered ink having a shape substantially similar to the shape of the recess in the ink template.

12. The apparatus of claim 11, where the stamping member is positionable between an extended position and a stamping position, where, in the stamping position, the stamping member is positioned in contact with the substrate and where, in the extended position, the stamping member is positioned out of contact with the substrate.

13. The apparatus of claim 12, wherein the stamping member is further positionable in an inking position, where, in the inking position, the stamping member is positioned in contact with the ink template.

14. The apparatus of claim 11, where the ink capsule comprises a receptacle for retaining ink, the receptacle having a surrounding wall where at least one edge of the receptacle contacts the ink template to scrape excess ink from the ink template.

15. The apparatus of claim 11, wherein the ink capsule biasing member biases the at least one edge of the receptacle against the ink template with sufficient force to remove excess ink from a surface of the ink template when the ink template platform is repositioned between an ink receiving position and an ink delivering position.

16. A system comprising:

an ink template platform comprising a surface for engaging an ink template, the ink template having a recess for receiving ink;

at least one platform support wherein the ink template platform is slideably positionable between an ink receiving position and an ink delivering position using the at least one platform support, the ink template platform uncoupled from the at least one platform support while the ink template platform is in one of the ink receiving position and the ink delivering position such that the ink template platform is not permanently fastened to the at least one platform support;

an ink capsule positioned against a surface of the ink template, wherein the ink capsule delivers ink to the recess in response to the ink template platform being positioned in the ink receiving position;

a single ink capsule biasing member that positions the ink capsule against the surface of the ink template, the ink capsule biasing member centrically positioned against a top surface of the ink capsule; and an ink capsule clip device comprising a front retaining portion having a cross-sectional profile configured to engage a front portion of the ink template platform, the ink capsule clip device further comprising support members configured to fix a position of the ink capsule with reference to the ink template platform.

17. The system of claim 16, where the ink capsule clip device further comprises a cut-out portion disposed between the support members, the cut-out portion configured to allow an ink capsule biasing member stop to engage the ink capsule.

18. The system of claim 16, further comprising a stamping member positionable between an extended position and a stamping position, where, in the stamping position, the stamping member is positioned in contact with a substrate and where, in the extended position, the stamping member is positioned out of contact with the substrate.

19. The system of claim 16, where the ink capsule comprises a receptacle for retaining ink, the receptacle having a surrounding wall wherein at least one edge of the receptacle contacts the ink template to scrape excess ink from the ink template.

20. The system of claim 16, wherein the ink capsule biasing member biases the at least one edge of the receptacle against the ink template with sufficient force to remove excess ink from a surface of the ink template when the ink template platform is repositioned between an ink receiving position and an ink delivering position.

* * * * *